US007755553B2

(12) United States Patent
Packer et al.

(10) Patent No.: US 7,755,553 B2
(45) Date of Patent: Jul. 13, 2010

(54) MULTIBAND ANTENNA SYSTEM FOR BODY-WORN AND DISMOUNT APPLICATIONS

(75) Inventors: Malcolm Packer, Fairport, NY (US); Pablo Diez, Fairport, NY (US)

(73) Assignee: Harris Corporation, Melbourne, FL (US)

( * ) Notice: Subject to any disclaimer, the term of this patent is extended or adjusted under 35 U.S.C. 154(b) by 444 days.

(21) Appl. No.: 11/841,095

(22) Filed: Aug. 20, 2007

(65) Prior Publication Data

US 2009/0051609 A1 Feb. 26, 2009

(51) Int. Cl.
*H01Q 1/12* (2006.01)
*H01Q 9/16* (2006.01)

(52) U.S. Cl. ..... 343/718; 343/790; 343/792

(58) Field of Classification Search ..... 343/792, 343/790, 793, 791, 718, 715
See application file for complete search history.

(56) References Cited

U.S. PATENT DOCUMENTS 4,410,893 A 10/1983 Griffee
4,940,989 A * 7/1990 Austin ..... 343/749
5,087,922 A 2/1992 Tang et al.
6,940,462 B2 9/2005 Packer
6,963,313 B2 11/2005 Du
6,985,121 B1 * 1/2006 Bogdans et al. ..... 343/792
7,053,851 B1 5/2006 Bogdans et al.
7,158,087 B2 1/2007 Dai et al.
7,164,389 B1 * 1/2007 Platt ..... 343/790
7,239,286 B1 * 7/2007 Miller et al. ..... 343/792

FOREIGN PATENT DOCUMENTS

EP 1 349 235 10/2003
EP 1 401 051 3/2004

* cited by examiner

*Primary Examiner*—HoangAnh T Le
(74) *Attorney, Agent, or Firm*—Fox Rothschild, LLP; Robert J. Sacco

(57) ABSTRACT

Antenna assembly 100 to be worn by a user includes a low-band dipole antenna (310) and at least one high band dipole antenna (312, 612). The high-band dipole antenna is comprised of a high-band dipole feed (102, 602) interposed at a location along a length of a low-band dipole element (105, 110). The high-band dipole feed divides the first low-band dipole element into a first high-band dipole element (128) and a second high-band dipole element (130). One of the high-band dipole elements (130) is formed as a flexible electrically conductive sleeve. An RF control device (308) is provided for selectively directing RF energy in a high-band to the high-band dipole feed (102), and for selectively directing RF energy in a low-band to the low-band dipole feed (202). A transmission line (113) extends from the RF control device (308) to the high-band dipole feed (102).

22 Claims, 7 Drawing Sheets

100
128
102
105
314
113
HIGH BAND IMPEDANCE MATCHING NETWORK
HIGH BAND DIPOLE ANTENNA (312)
$Z_{314}$
303
318
306
105
130
302
304
106
301
LOW BAND DIPOLE ANTENNA (310)
$Z_{302}$
LOW BAND IMPEDANCE MATCHING NETWORK
RF CONTROL DEVICE
308
316
202
111
TO PORTABLE COMMUNICATION DEVICE (125)
110
132
204
204
204
133
110
134

MULTIBAND ANTENNA SYSTEM FOR BODY-WORN AND DISMOUNT APPLICATIONS

BACKGROUND OF THE INVENTION

1. Statement of the Technical Field

The invention relates to the field of communications. More particularly, this invention relates to an antenna assembly for a portable communications device.

2. Background of the Invention

Portable hand-held radio communication devices are often limited with regard to their long range communications capabilities. This limitation is generally attributable to the relatively low effective radiated power (ERP) associated with such radios. The relatively low ERP is due primarily to the relatively low power output of the radio frequency (RF) amplifiers used in such radios, and the poor efficiency of the antennas. For example, many of these handheld radios have conventionally been equipped with a short flexible antenna sometimes referred to as a "rubber duck" antenna or "whip" antenna. These antennas are essentially shortened vertical monopole antennas which have been electrically loaded so as to reduce their overall physical length. While such antennas are convenient, their performance is often limited by their small size and the absence of an effective counterpoise.

U.S. Pat. No. 6,940,462 to Packer (hereinafter "Packer") discloses a body-worn antenna which overcomes many of the limitations associated with shortened, electrically loaded vertical monopole designs. In particular, Packer teaches a broadband dipole antenna that is removably fastened to a garment of the user. The antenna assembly is coupled to a portable handheld radio which is also carried by the user. The body-worn dipole design of the antenna disclosed by Packer provides higher gain and improved efficiency as compared to conventional vertical monopole designs. These improvements are attributable to the electrically balanced design of the dipole and larger physical size of the antenna.

Still, there remains a continuing need for antenna systems that offer improved performance. In particular, there is a continuing need for antennas that provide higher gain and wider operating bands. These capabilities can enable small portable hand-held radios to provide equal or better range performance compared to larger man-pack radios which are conventionally carried in a ruck-sack.

SUMMARY OF THE INVENTION

An antenna assembly to be worn by a user includes a low-band dipole antenna. The low-band dipole antenna is comprised of a low-band dipole feed electrically coupled to a first low-band dipole element extending outwardly from the low-band dipole feed in a first direction. The low-band dipole antenna also includes a second low-band dipole element connected to and extending outwardly from the low-band dipole feed in a second direction opposed from the first direction.

The antenna assembly also includes a high band dipole antenna. The high-band dipole antenna is comprised of a high-band dipole feed interposed at a location along a length of the first low-band dipole element. The high-band dipole feed divides the first low-band dipole element into a first high-band dipole element extending outwardly from the high-band dipole feed in the first direction and a second high-band dipole element extending in the second direction. The high-band dipole feed is electrically coupled to the first and second high-band dipole elements.

Significantly, at least one of the high-band dipole elements is formed as a flexible electrically conductive sleeve. For example the flexible electrically conductive sleeve can comprise a pair of spirally wound, interlocking, electrically conductive elements. The flexible electrically conductive sleeve surrounds a transmission line that extends from the low-band dipole feed to the high-band dipole feed.

An RF control device is provided for selectively directing RF energy in a high-band to the high-band dipole feed, and for selectively directing RF energy in a low-band to the low-band dipole feed. In this regard, it should be understood that the low band comprises an RF range that is lower as compared to an RF range of the high band. For example, the low band can be the VHF band and the high-band is the UHF band. The RF control device is selected from the group consisting of an RF diplexer and an RF switch. If RF control device is an RF switch, it can be controlled by a portable transceiver to which the antenna assembly is connected.

A low-band impedance matching network is provided for the low-band dipole antenna. Similarly, a high-band impedance matching network is provided for the high-band dipole antenna. The low-band dipole feed and the RF control device are advantageously disposed within a dielectric body which physically supports the first and second low-band dipole elements.

The high-band dipole feed further comprises a first impedance transformer electrically coupled to the first and second high-band dipole elements and to the high-band impedance matching network. The first impedance transformer is disposed within a dielectric body which supports the first and second high-band dipole elements. The low-band dipole feed further includes a second impedance transformer electrically coupled to the first and second low-band dipole elements and to the low-band impedance matching network.

A secondary winding of the second impedance transformer is connected to the first and second low-band dipole elements. The secondary winding has a high impedance to electric current at all frequencies in the high-band such that the second low-band dipole element is electrically isolated from the high-band dipole antenna at RF frequencies in the high band. The first impedance transformer forms a low impedance path for coupling electric current from the second high-band dipole element to the first high-band dipole element at RF frequencies in the low band.

The second low-band dipole element is also advantageously constructed as a flexible electrically conductive sleeve. The flexible electrically conductive sleeve surrounds a second RF transmission line that extends from the low-band dipole feed to an RF input port of the antenna at a location disposed along a length of the second low-band dipole element. One or more ferrite bodies are disposed about a portion of the second RF transmission line at a location adjacent to the RF input port.

An alternative embodiment of the antenna assembly also includes a second high-band dipole antenna. The second high-band dipole antenna includes a second high-band dipole feed interposed at a location along a length of the second low-band dipole element. The second high-band dipole feed divides the second low-band dipole element into a third high-band dipole element extending outwardly from the second high-band dipole feed in the first direction and a fourth high-band dipole element extending in the second direction. The second high-band dipole feed is electrically coupled to the third and fourth high-band dipole elements. The flexible electrically conductive sleeve that defines the second low-band dipole element surrounds a third RF transmission line that extends from the low-band dipole feed to the second high-band dipole feed. The RF control device directs RF energy in the high-band to the first and second high-band dipole feed in phase. The second high-band dipole feed can have an impedance transformer which includes a secondary winding. The secondary winding is connected to the third and fourth high-band dipole elements and forms a low impedance path for RF in the low band.

BRIEF DESCRIPTION OF THE DRAWINGS

Embodiments will be described with reference to the following drawing figures, in which like numerals represent like items throughout the figures, and in which.

DETAILED DESCRIPTION OF THE PREFERRED EMBODIMENTS

Figure 1:
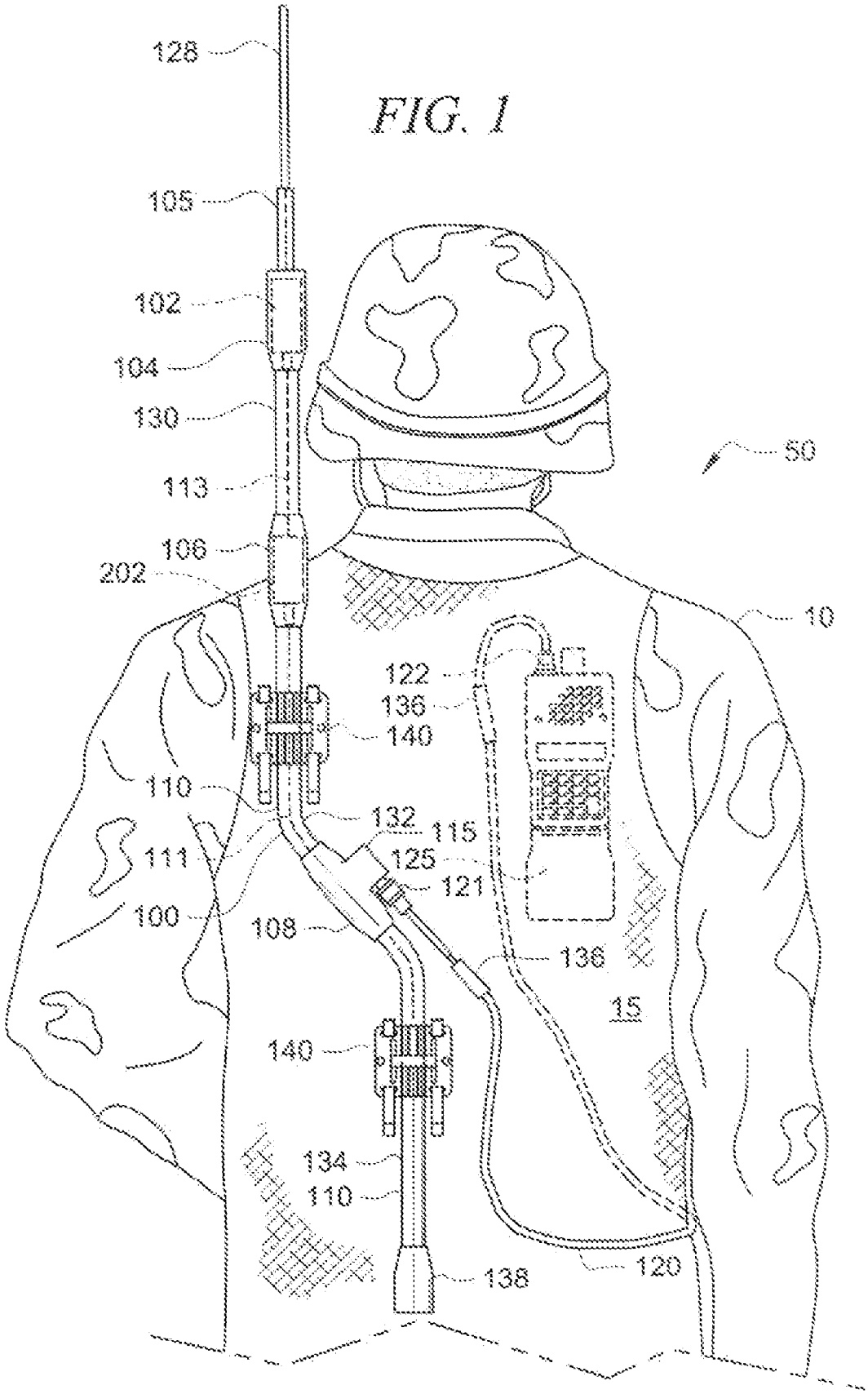
FIG. 1 is rear view of a user wearing a portable communication system comprising an antenna assembly and portable communication device which is useful for understanding an embodiment of the invention.

Referring now to FIG. 1, there is shown is a rear perspective view of a portable communication system 50 worn on at least one garment 15 of a user 10, according to one embodiment of the invention. The portable communication system 50 includes an antenna assembly 100 that is worn on at least one garment 15 of the user 10. The at least one garment 15 on which the portable communication system 50 can be worn includes shirts, belts, trousers, and vests or any other garment known to one of ordinary skill in the art. In the embodiment shown in FIG. 1, the garment 15 is a vest wherein the portable communication system 50 is mounted to be carried by the user 10. The vest 15 could be of the type commonly worn by a soldier containing body armor for protecting the upper body of the soldier from impact from projectiles or the like.

The portable communication system 50 can include a portable communication device 125 such as a portable radio that can also be worn on the garment 15 of the user 10. For example, the portable communication device 125 could be a portable radio such as the Harris Corporation Model RF-5800M-HH radio that is a small, lightweight VHF/UHF handheld radio offered by Harris RF Communications Division of Rochester, N.Y. The Model RF-5800M-HH radio operates over a broad frequency range of 30-512 MHz which is commonly used in special operations and platoon-level communications to the squad and individual soldier. However, the invention is not limited in this regard as other portable communication devices could be used as is known to one of ordinary skill in the art.

The portable communication device 125 could be conventionally equipped with a small "rubber duck" or "whip antenna" (not shown) as a primary antenna. However, such antennas are known to be relatively inefficient. In view of the foregoing, the rubber duck or whip antenna can be disconnected from portable communication device 125 and replaced with antenna assembly 100. Coupling antenna assembly 100 to the portable communication device 125 in place of the rubber duck or whip antenna can facilitate longer range communication ability. In addition, the antenna assembly 100 can be worn on the garment 15 of the user 10 to eliminate the problem of having to carry a larger portable communication device 125 in a rear pack with its unwieldy conventional blade antenna. This arrangement also allows the portable communication device 125 to be worn on the front of the garment 15 of the user 10 where it is more convenient to operate.

Figure 2:
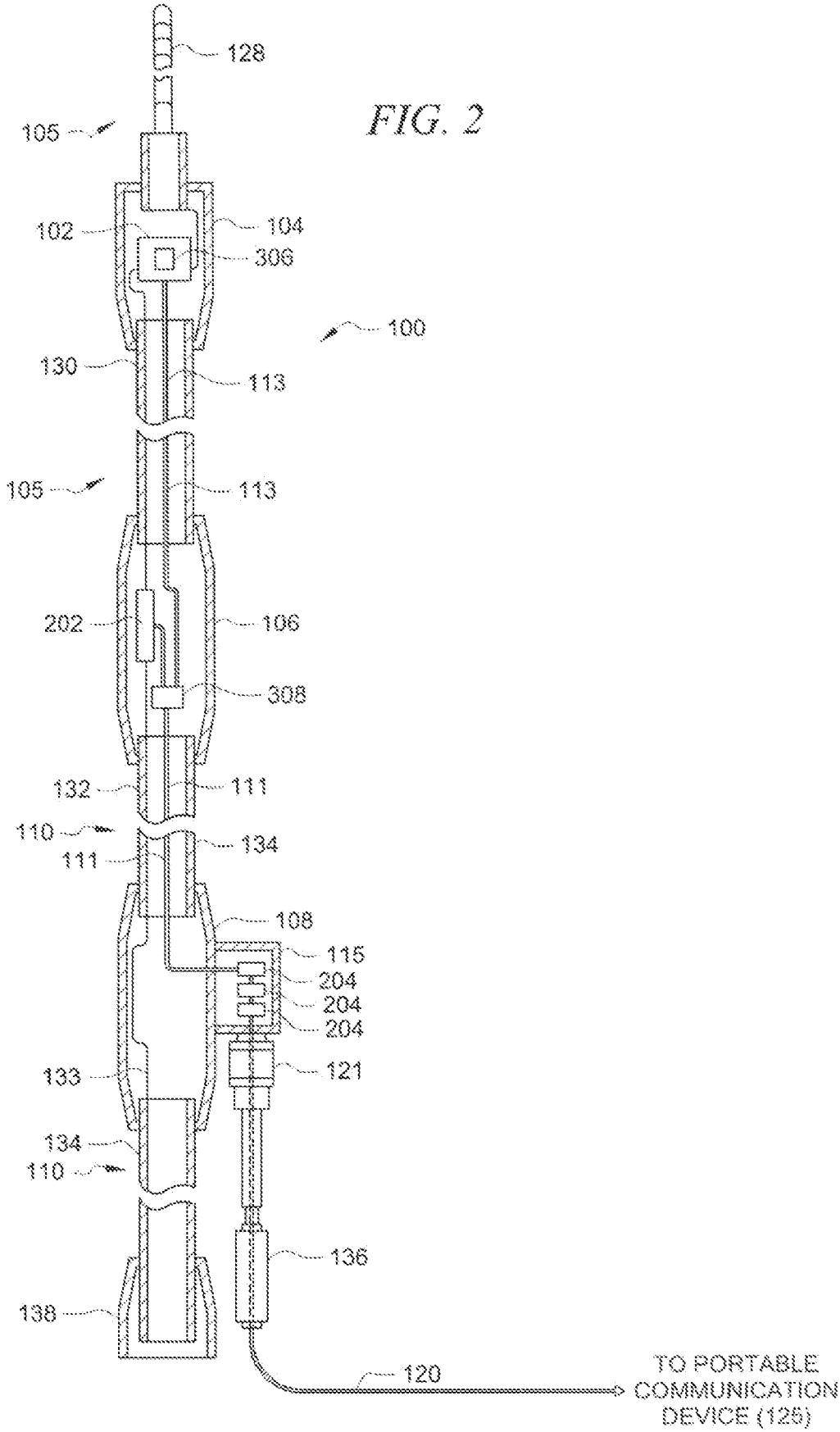
FIG. 2 is a cross-sectional view of the antenna assembly in FIG. 1.

Referring now to FIGS. 1 and 2, the antenna assembly 100 is essentially a vertical dipole arrangement. The antenna assembly includes a molded section 106. The molded section 106 comprises a dielectric housing which contains a low-band dipole feed assembly 202. A first low-band dipole element 105 extends away from the low-band dipole feed assembly 202 in a first direction as shown. A second low-band dipole element 110 extends away from the low-band dipole feed assembly 202 in a second direction, which is generally opposed from the first direction as shown.

According to an embodiment of the invention, the second low-band dipole element 110 can be comprised of two sections, namely an upper section 132 and a lower section 134. The upper section 132 and the lower section 134 can be physically connected by a molded section formed of a dielectric material. The upper section 132 and the lower section 134 are formed of a flexible body portion or electrically conductive sleeve. Together, the upper section 132 and the lower section 134 serve as the second low-band dipole element. In this regard, a conductive link 133 can be provided to electrically connect the upper section 132 to the lower section 134. A molded end cap 138 can be provided on an end portion of the lower section 134 to prevent moisture and particle of dirt from entering into the lower section 134. The molded end cap 138 can be formed of a dielectric material or conductive metal.

The first low-band dipole element 105 also includes two sections. These include an upper section 128 and a lower section 130. The upper section 128 and the lower section 130 are physically connected by a molded section 104 which can be formed of a dielectric material. The lower section 130 can be formed of a flexible body portion or electrically conductive sleeve. For example, the electrically conductive sleeve can be of a similar construction to the one that is used to form the second low-band dipole element 110. The upper section 128 of the first low-band dipole element 105 can be formed of a series of progressively longer strip-shaped conductors in a retractable or nested arrangement. Such arrangements are well known by those skilled in the art. Accordingly, the upper section 128 can be folded for storage and transportation, but when released will spring to a fully extended position. Still, the invention is not limited in this regard and any other suitable conductor can also be used to form the upper section 128.

For the VHF range described above, the overall length of the first dipole element 105 may be about thirty inches. Similarly, the overall length of the second dipole element 110 can be about thirty inches. Still, it should be understood that the invention is not limited in this regard. For example, the actual length of the dipole elements can depend on the frequency bands on which the antenna assembly is to be operated.

A high-band dipole feed 102 is disposed within the molded section 104. The molded section 104 can be formed of a dielectric material. The high-band dipole feed 102 is electrically connected to the upper section 128 and the lower section 130 which together comprise the first low-band dipole element 105. Significantly, the upper section 128 and the lower section 130 also respectively comprise a first high-band dipole element and a second high-band dipole element. Hereinafter, for purposes of clarity, upper section 128 may also be referred to as the first high-band dipole element. Similarly, lower section 130 may also be referred to as the second high-band dipole element. For the UHF range, the overall length of the first high-band dipole element can be about 15 inches. The second high-band dipole element can also have a length of about 15 inches for a total high-band dipole length of about 30 inches.

The electrically conductive sleeve which comprises the second low-band dipole element 110 surrounds a transmission line 111. According to one embodiment of the invention, the transmission line 111 can be selected to include a coaxial arrangement of conductors such as is commonly used in coaxial type cable. However, the invention is not limited in this regard. The transmission line 111 can also be coupled to a noise filter that is contained within the molded section 115. The noise filter 204 can be comprised of one or more ferrite toroids 204. The noise filter can be useful for reducing interfering noise delivered from the antenna assembly 100 to the receiver in the portable communications device 125. A connector 115 can be disposed on molded section 108 for coupling to a first connector 121 on one end of the coaxial cable 120. A second connector 122 can be provided on the opposite end of the coaxial cable 120 for coupling to a connector (not shown) on the portable communication device 125. Ferrite sleeves 136 are advantageously provided to reduce noise and unwanted currents which may exist on the shield of the coaxial cable 120.

The electrically conductive sleeve which comprises the high-band dipole's lower element 130 surrounds a second transmission line 113. According to an embodiment of the invention, the second transmission line 113 can be a coaxial arrangement of conductors as is commonly found in coaxial cable. However, the invention is not limited in this regard. The transmission line 113 can be coupled at one end to the RF control device 308 and at a second end to the high-band dipole feed 102. These features will be discussed in more detail below in relation to FIG. 3.

Figure 4:
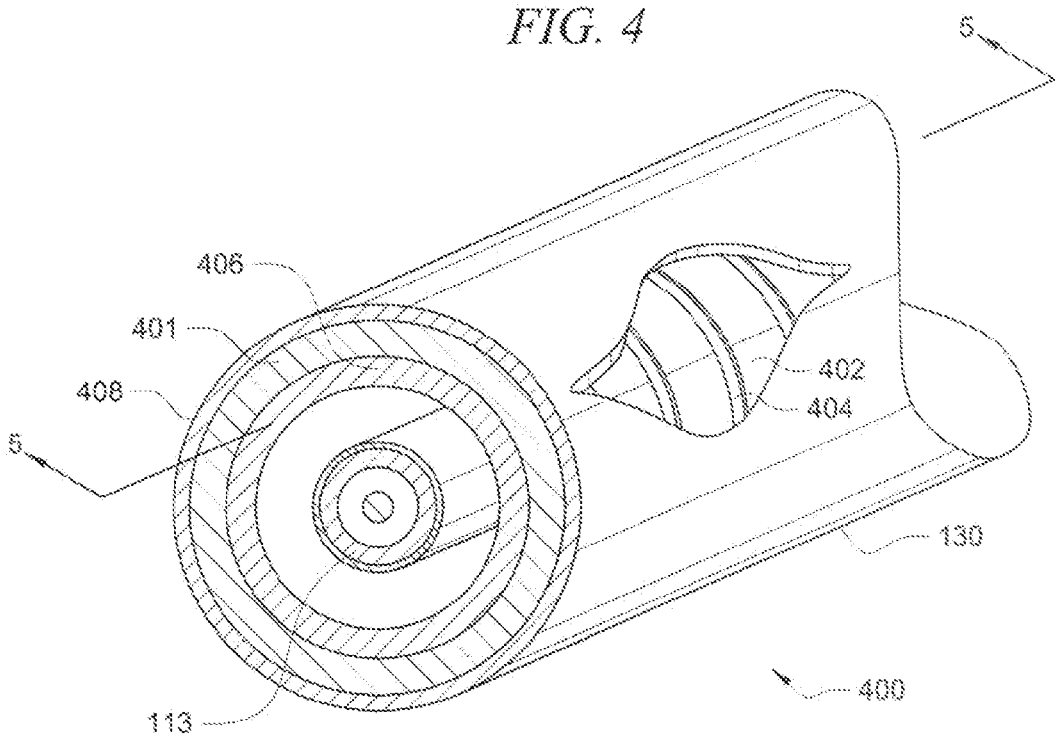
FIG. 4 is a drawing that is useful for understanding a structure of a dipole element forming the antenna assembly in FIG. 1.
Figure 5:
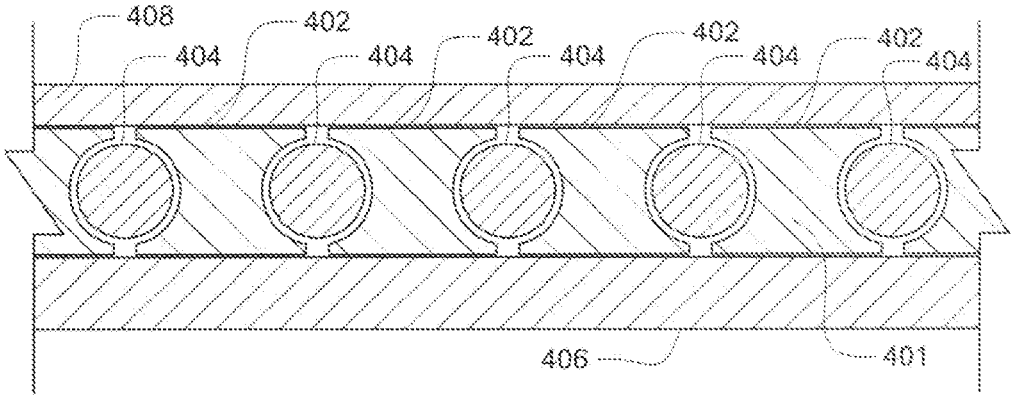
FIG. 5 is a cross-sectional view taken along line 5-5 that is useful for understanding a structure of a flexible electrically conductive sleeve that can be used to form a dipole element of the antenna assembly in FIG. 1.

Referring now to FIG. 4, there is shown a portion of the flexible electrically conductive sleeve 400 used to form lower section 130 of the first low-band dipole element 105. In FIG. 4, transmission line 113 is shown disposed within the interior of the conductive sleeve 400. A similar construction is used to form the second low-band dipole element 110. The electrically conductive sleeve 400 is preferably formed as a flexible structure. For example, the flexible electrically conductive sleeve 400 may be formed of a solid conductor. However, in another preferred embodiment as shown in FIG. 5, the flexible sleeve 400 may comprise a pair of spirally wound, interlocking, electrically conductive elements 402, 404, for example. An interior dielectric layer 406 and an exterior dielectric layer can complete the flexible electrically conductive sleeve. Other configurations are also envisioned as will be appreciated by those skilled in the art.

Referring once again to FIG. 1, the antenna assembly 100 is mounted to the garment 15 using at least one user-worn antenna fastening device 140. In the embodiment shown in FIG. 1, there is an upper user-worn antenna fastening device 140 mounted on garment 15 near the left shoulder of the user 10 and a lower user-worn antenna fastening device 140 mounted centrally on the garment 15 above the waist of the user 10. However, the invention is not limited in this regard as any number of user-worn antenna fastening devices 140 could be used and mounted in any location on the garment 15 of the user 10.

In addition, the invention is not limited to the use of the user-worn antenna fastening device 140 on the clothing or garment 15 of the user 10. In another embodiment of the invention (not shown), the antenna fastening device 140 could be mounted on a surface, such as vehicle panel for mounting the antenna assembly 100 in a vehicle. Still, the invention is not limited in this regard as the antenna fastening device 140 could be used to mount the antenna assembly 100 in any desired location as is known to one of ordinary skill in the art. Other uses for the antenna will also be understood by those skilled in the art. For example, the antenna could be suspended from an object, such as a tree limb in order to increase communications range.

Figure 3:
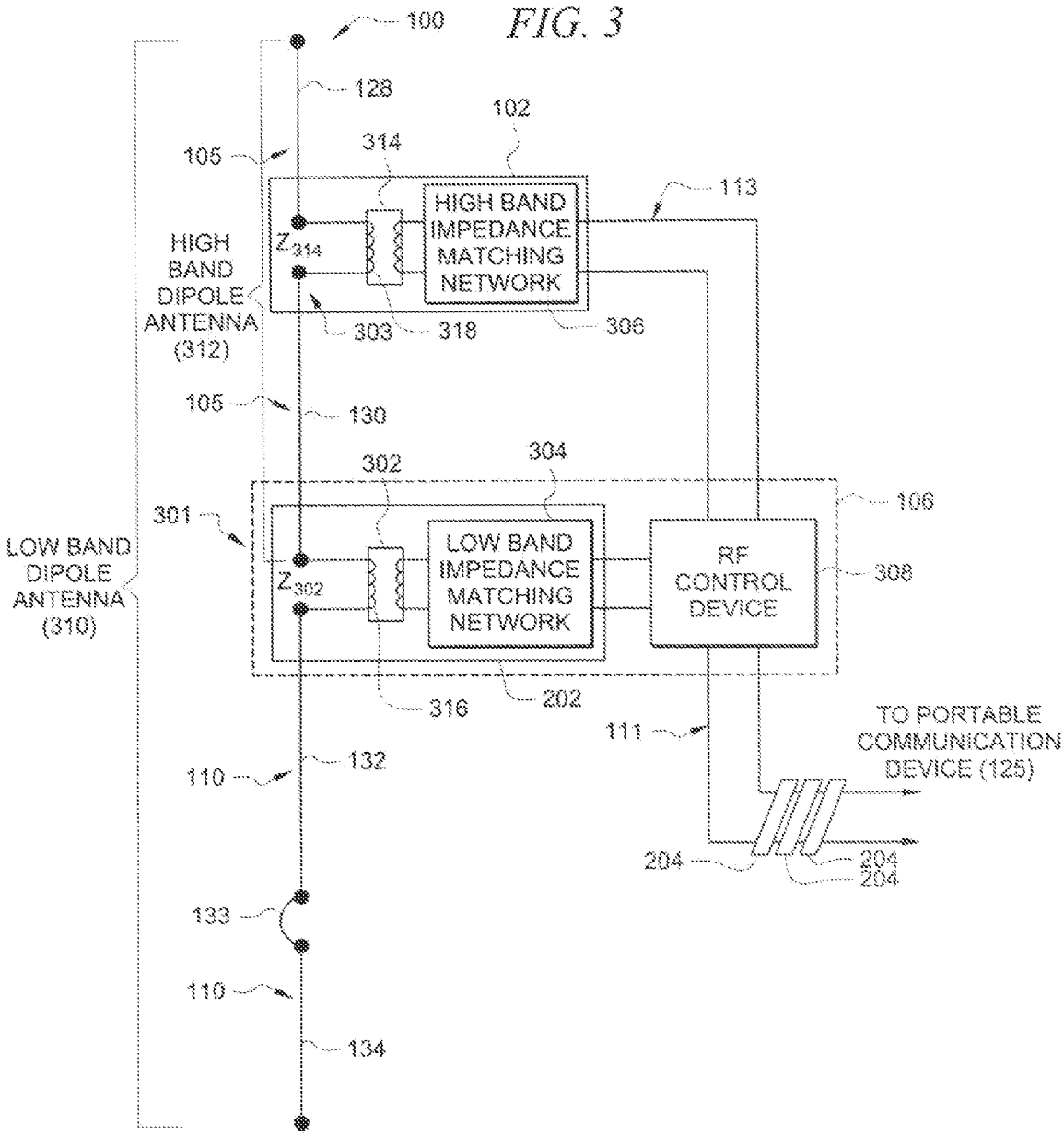
FIG. 3 is a schematic diagram that is useful for understanding the operation of the antenna assembly in FIG. 1.

Referring now to FIG. 3, there is provided a block diagram that is useful for understanding the electrical features of antenna assembly 100. The antenna assembly 100 includes an RF control device 308, a low-band dipole antenna 310 and a high band dipole antenna 312. The low-band dipole antenna 310 is formed from the low-band dipole feed assembly 202, the first low-band dipole element 105 and the second low-band dipole element 110. The low-band dipole feed assembly 202 includes a low-band impedance matching network 304 and a low-band impedance transformer 302. As noted above, the upper section 132 and lower section 134 of the second low-band dipole element 110 can be electrically connected by means of a conductive link 133 so as to form a single low-band dipole element. According to one embodiment, the RF control device 308, the low-band impedance matching network 304, and the impedance transformer 302 can all be disposed within the molded portion 106

Still referring to FIG. 3, it can be observed that the high-band dipole antenna 312 is formed as a part of the first low-band dipole element 105. In particular, the upper section 128 and lower section 130 respectively comprise the first high-band dipole element and the second high-band dipole element. The high-band dipole feed 102 is electrically connected to each of the upper section 128 and lower section 130 as shown. The high-band dipole feed 102 can advantageously include an impedance transformer 314. A high-band impedance matching network 306 is provided. According to one embodiment, discrete passive components, such as inductors and capacitors, can be used to implement the high-band impedance matching network. According to an alternative embodiment, the high-band impedance matching network can comprise the transmission line 113. In other words, instead of using discrete components, the transmission line 113 can itself be used to perform an impedance matching function. In such case, the function of the separate high-band impedance matching network 306 can be provided instead by the transmission line 113 in combination with the impedance transformer 314. Techniques for using transmission lines in this manner are well known in the art and therefore will not be described here in detail.

The operation of antenna assembly 100 will now be described. RF energy is communicated to an RF control device 308 through transmission line 111. The RF control device 308 can be disposed within the molded section 106. The RF control device 308 is selectively coupled to either the low-band impedance matching network 304 or the high-band impedance matching network 306. In particular, a low-band type of RF energy having a frequency within a first range can be communicated to the low-band impedance matching network 304. For example, low-band type RF energy can include signals in the VHF frequency range. Similarly, a high-band type of RF energy having a frequency within a second range that is higher than the first range can be communicated to the high-band impedance matching network 306. For example, high-band type RF energy can include signals in the UHF frequency range.

It will be understood by those skilled in the art that the RF control device 308 can take the form of an RF switch or an RF diplexer, without limitation. If the RF control device 308 is an RF switch, it can be advantageously controlled by means of one or more control signals generated by the portable communication device 125. These control signals can be communicated to the RF control device 308 through transmission line 111 or through dedicated control lines (not shown). Various means for communicating antenna control signals using RF transmission lines are well known in the art and therefore will not be described here in detail. However, it should be understood that one such method can include a switched DC control signal and one or more blocking capacitors to isolate the control signal from the antenna elements and sensitive RF circuitry.

The portable communication device 125 can generate the necessary control signal for an RF switch to determine whether RF signals are communicated by the RF control device 308 to either the high-band impedance matching network 306 or the low-band impedance matching network 304. For example if the portable communication device 125 is operated in the VHF band, the control signals can cause the RF control device 308 to route RF signals to the low-band impedance matching network 304. Alternatively, if the portable communication device is operated in a UHF band, the control signals can cause the RF control device 308 to route RF signals to the high-band impedance matching network 306.

According to an alternative embodiment the RF control device 308 can be an RF diplexer. In that case, low-band RF signals can be automatically routed to the low-band impedance matching network by passive circuitry associated with the RF diplexer. Similarly, high-band RF signals can be automatically routed to the high-band impedance matching network 306 using such passive circuitry. RF diplexers are well known in the art and therefore will not be described in detail. However, it should be understood that there are a variety of techniques that can be used for implementing such RF diplexers. Further, it will be understood that a passive RF diplexer can advantageously eliminate the need for antenna control signals. Still, the invention is not limited in this regard and any other suitable means can be used for controlling a flow of RF energy to either the high-band impedance matching network 306 or the low-band impedance matching network 304.

As will be understood from the foregoing discussion, low-band type RF signals will be communicated to the low-band impedance matching network 304. The low-band impedance matching network 304 operates in cooperation with impedance transformer 302 to provide broad band impedance matching. According to one embodiment of the invention, the impedance transformer 302 can step-up the input impedance of the low-band dipole antenna to a relatively higher impedance value. The low-band impedance matching network 304 can then be selected to match the impedance of the transmission line 111 to the relatively higher impedance value provided by the impedance transformer 302. As will be appreciated by those skilled in the art, this arrangement can advantageously minimize the loss of RF power communicated to the low-band dipole antenna 310 which can be otherwise caused by impedance mismatches.

The high-band impedance matching network 306 operates in cooperation with impedance transformer 314 to provide broad band impedance matching between the input transmission line 111 and the high-band dipole antenna 312. According to one embodiment of the invention, the impedance transformer 314 can step-up the input impedance of the high-band dipole antenna 312 to a relatively higher impedance value. The high-band impedance matching network 306 can then be selected to match the impedance of the transmission line 111 to the relatively higher impedance value provided by the impedance transformer 314. As will be appreciated by those skilled in the art, this arrangement can advantageously minimize the loss of RF power communicated to the high-band dipole antenna 312, which losses can be otherwise caused by impedance mismatches. In the arrangement shown in FIGS. 1-3, it should be understood that transmission line 113 can form a part of the high-band impedance matching network 306. Alternatively, the function of the high-band impedance matching network 306 can be performed by transmission line 113 operating in combination with the impedance transformer 314. In other words, the high-band impedance transformer can be integrated into transmission line 113 and the impedance transformer 314. Transmission lines are commonly used for such matching purposes and therefore these techniques will not be described here in detail.

Still referring to FIG. 3, the configuration of the low-band dipole feed assembly is preferably such that the input impedance $Z_{302}$ will be relatively high in value at frequencies associated with the high-band. For example, the impedance at $Z_{302}$ can be chosen so that it operates effectively as an open circuit for all frequencies within the high-band. In this way, the low-band dipole feed assembly 202 and the second low-band dipole antenna element 110 can be effectively decoupled or isolated from the high-band dipole antenna 312 when the high-band dipole antenna is operated at frequencies contained within the high-band. Conversely, the input impedance $Z_{314}$ as observed at the output of the high-band feed 102 is selected so that it is effectively a short circuit for all frequencies within the low-band. In this way, the high-band dipole feed 102 can effectively couple RF energy between upper section 128 and the lower section 130 of the first low-band dipole antenna element 105 at low-band frequencies. Moreover, RF currents can flow from element 130 to element 128 so as to provide in combination a low-band dipole antenna element 105.

The foregoing impedances $Z_{314}$ and $Z_{302}$ can be provided by selectively choosing the impedance of secondary winding 318, 316 of impedance transformers 314 and 302, transmission line 113 and matching networks 306, 304. The impedance values are selected such that when RF energy in the frequency band of the high-band is fed into the high-band dipole antenna 312, the impedance value that appears at the secondary winding 316 is extremely high. For example, this impedance value is preferably greater than 1000 ohms. This high impedance effectively functions as an open circuit to currents associated with RF energy at frequencies in the high-band (e.g. frequencies in the UHF band). Similarly, the secondary winding 318 of impedance transformer 314 has a relatively low impedance value so that a short circuit is effectively created for currents associated with low-band RF energy (e.g. VHF band). For example, the impedance value can be in the range of 0 to 10 ohms. Consequently, the secondary winding 316 effectively functions as a short circuit at frequencies within the low-band.

Figure 6:
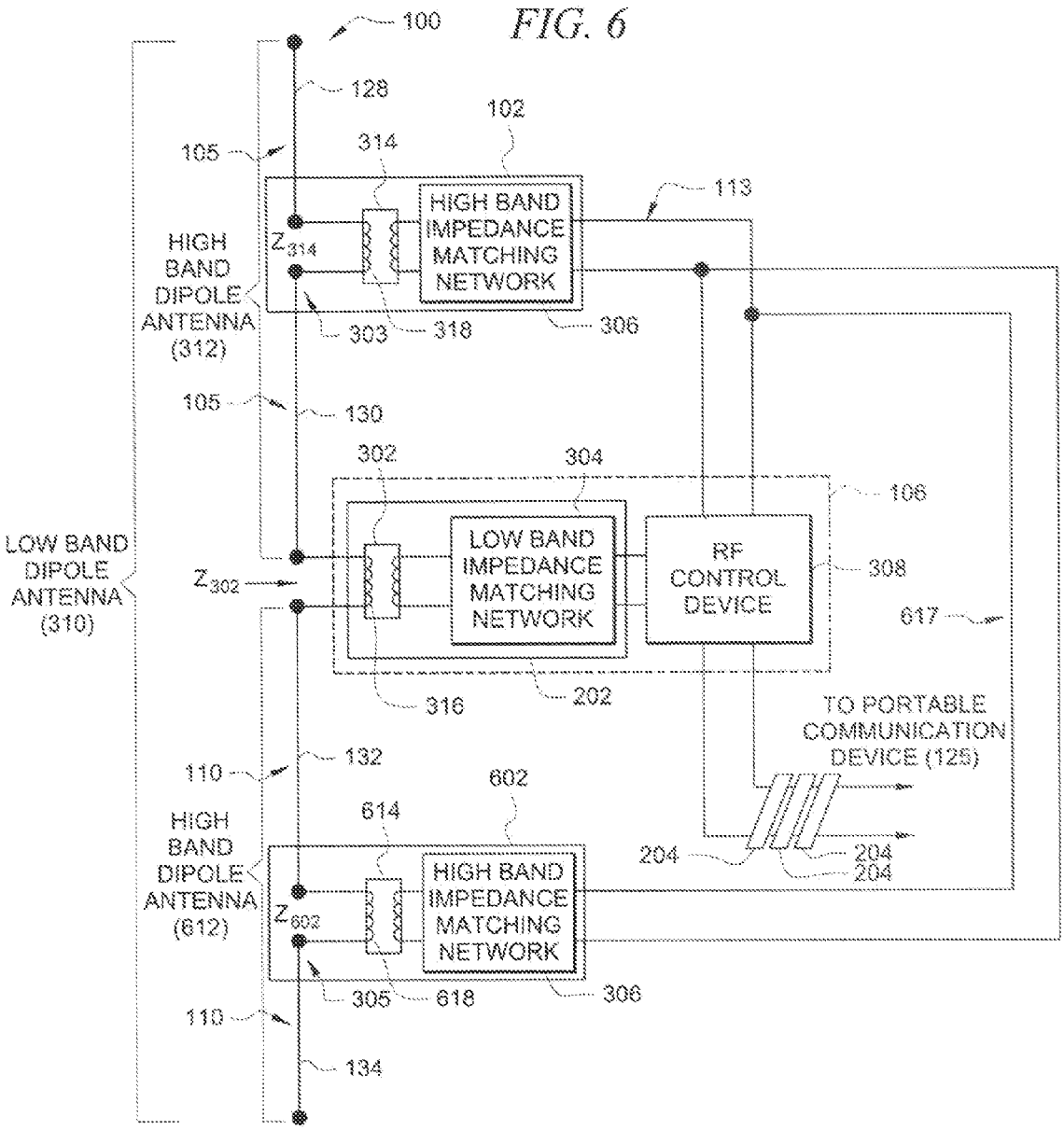
FIG. 6 is a schematic diagram that is useful for understanding the operation of an alternative embodiment of the antenna assembly in FIG. 1.
Figure 7:
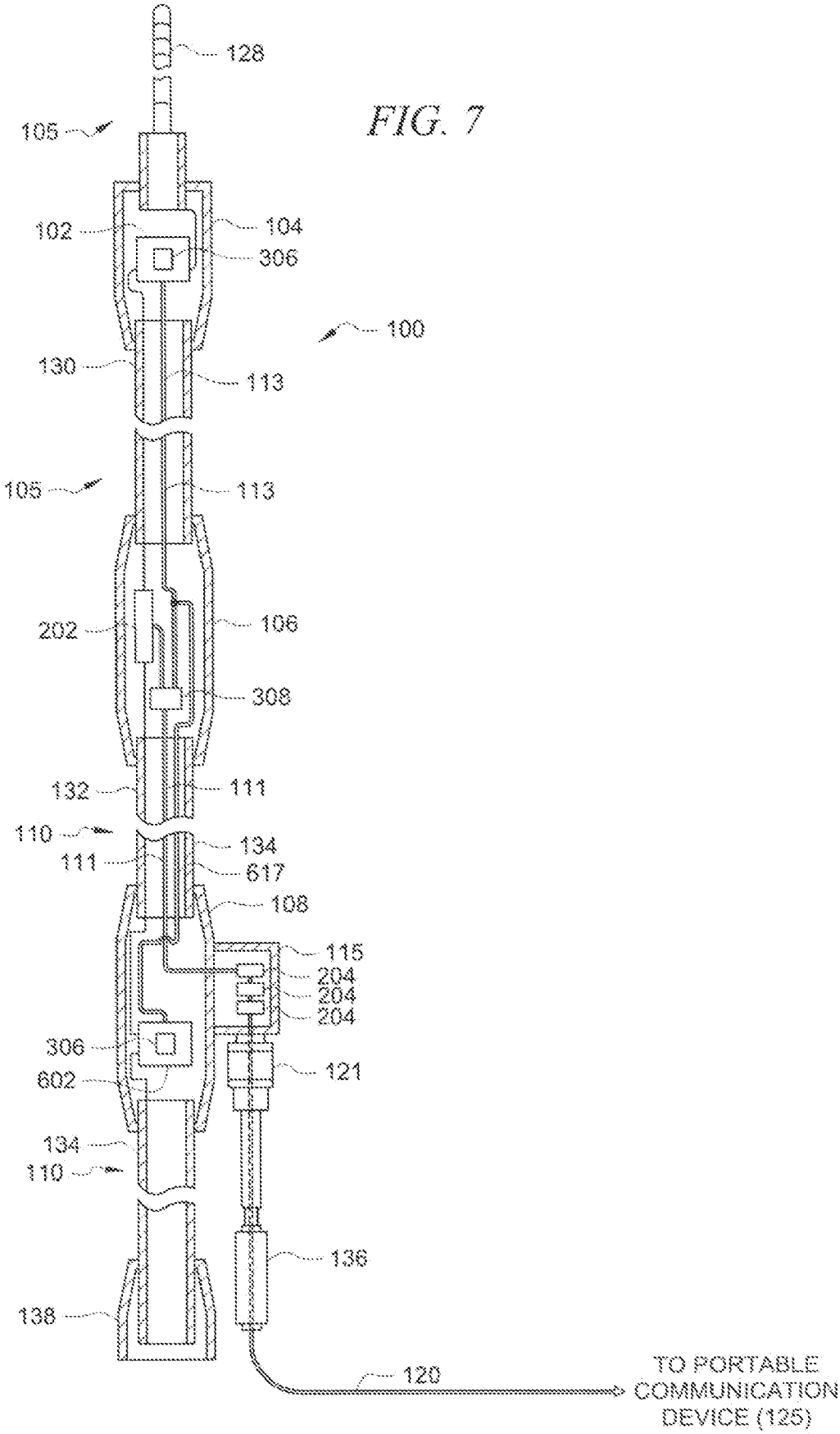
FIG. 7 is a cross-sectional view of an alternative embodiment of the antenna assembly in FIG. 1 and FIG. 6.

Referring now to FIGS. 6 and 7, there is shown an alternative embodiment of the invention. In FIGS. 6 and 7, structure corresponding to that which is shown in FIGS. 2 and 3 is identified using like reference numerals. It will be appreciated that FIGS. 6 and 7 are similar to FIGS. 2 and 3 except that in FIGS. 6 and 7. However, in FIGS. 6 and 7, the upper section 132 and the lower section 134 of the second low-band dipole antenna element 110 also serve as a second high-band dipole antenna 612.

In FIGS. 6 and 7, transmission line 617 is used to couple RF energy from the RF control device 308 to the second high-band dipole antenna 612. As illustrated in FIG. 7, the transmission line 617 can be contained within the upper section 132 of the electrically conductive sleeve used to form the second low-band dipole element 110. According to one embodiment, the transmission line 617 comprises an arrangement of coaxial conductors similar to the transmission line 113. Similar to the arrangement used to feed the high-band dipole antenna 312, the transmission line 617 is coupled to a second high-band dipole feed 602. The second high-band dipole feed 602 can be contained within the molded section 108 as shown in FIG. 7.

Referring again to FIG. 6, the second high-band dipole feed 602 can advantageously include an impedance transformer 614 which has a design and function similar to that described above with respect to impedance transformer 314. For example, a secondary winding 618 of the impedance transformer 614 can be electrically connected to the upper section 132 and the lower section 134 comprising the second high-band dipole antenna 612. According to a preferred embodiment, the high-band dipole antenna 312 and the high-band dipole antenna 612 are concurrently fed high-band RF energy in phase so that an overall gain of the antenna assembly 100 is improved for high-band RF radiation at low angles of elevation. In this regard, it should be understood that the impedance used for the secondary winding 618 is preferably selected so that it presents low impedance to RF signals having frequencies within the low-band described above. As such, the secondary winding 618 can function as a relatively low impedance path for RF currents flowing between upper section 132 and lower section 134. For example, the secondary winding can effectively function as a short circuit at the low-band frequencies (e.g. VHF).

Figure 8:
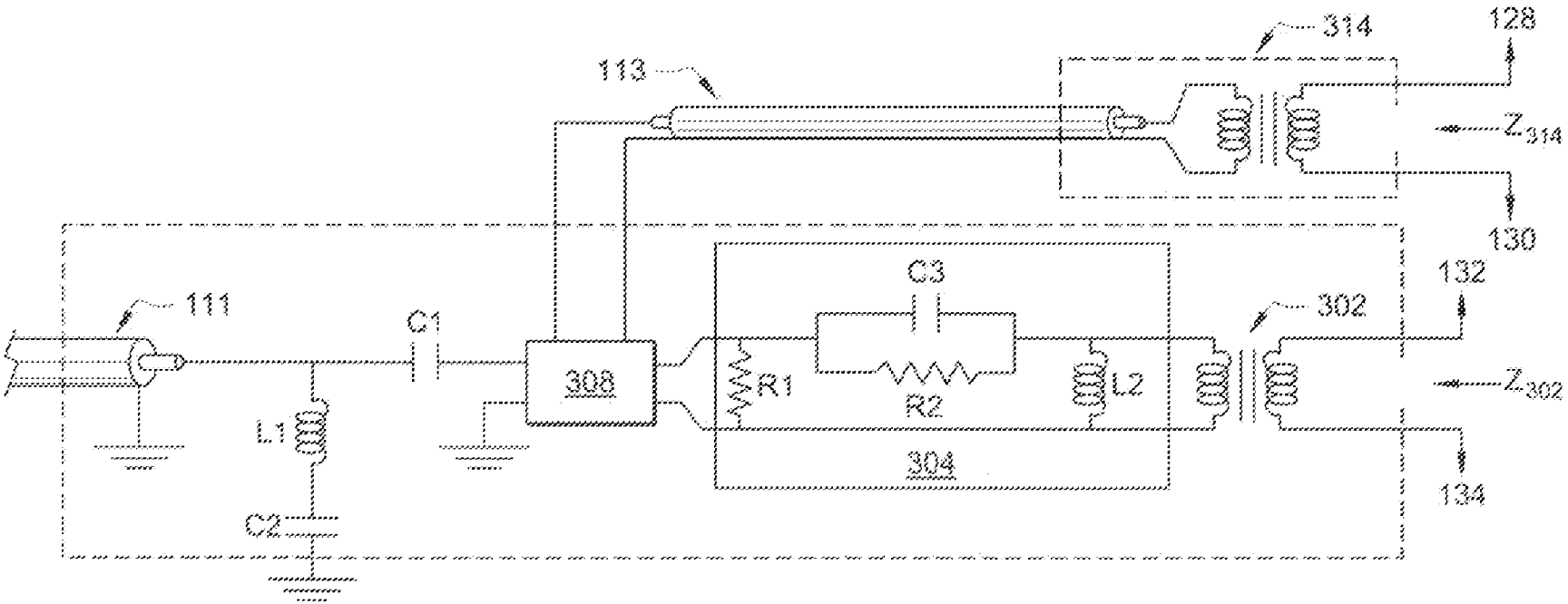
FIG. 8 is a schematic diagram useful for understanding the internal wiring of the antenna assembly in FIG. 1

Referring now to FIG. 8, there is shown a schematic diagram of a low-band impedance matching network 304 for use with the present invention. In the embodiment shown, the RF control device 308 is an RF switch that is responsive to a DC bias voltage communicated from portable communication device 125. The DC bias voltage is communicated in this embodiment through the transmission line 111. A DC bias circuit is comprised of C1, L1 and C2. The DC bias circuit will remove a DC bias voltage from transmission line 111. During high-band (e.g., UHF) operation the DC bias voltage will cause RF control device 308 to direct the RF signal to the high-band dipole antenna through transmission line 113. Note that in the embodiment shown in FIG. 8, the high-band impedance matching network 306 is not shown. This is because the function of the high-band impedance matching network 306 is integrated with the transmission line 113 and the impedance transformer 314 in the embodiment shown.

During low-band operation (e.g. VHF) operation there is no DC applied through the transmission line 111. Accordingly, the RF control device 308 returns to its normal state and RF energy is communicated to the low-band matching network 304. The low-band impedance matching network is comprised of passive components (R1, C3, R2, L2) and the impedance transformer 302. The objective of this circuit is to match the impedance of the low-band dipole antenna 310 so that it provides an acceptable voltage standing wave ratio (VSWR) to the portable communication device. The high band impedance matching network is comprised of transmission line 113 and impedance transformer 314. The values of the various components in FIG. 8 is dependent on the frequency range of interest as will be appreciated by those skilled in the art. Still, it should be understood that the invention is not limited to the low-band and the high-band impedance matching networks described herein. Any other suitable matching network can also be used within the scope of the inventive arrangements.

All of the apparatus, and methods disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. An antenna assembly to be worn by a user, comprising:

a low-band dipole antenna including a low-band dipole feed electrically coupled to a first low-band dipole element connected to and extending outwardly from said low-band dipole feed in a first direction to a first terminal end of said antenna assembly, and to a second low-band dipole element connected to and extending outwardly from said low-band dipole feed in a second direction opposed from said first direction;

a high band dipole antenna comprising a high-band dipole feed interposed at a location along a length of said first low-band dipole element and dividing said first low-band dipole element into a first high-band dipole element extending outwardly from said high-band dipole feed in said first direction to said first terminal end of said antenna assembly, and a second high-band dipole element extending in said second direction to said low-band dipole feed, said high-band dipole feed electrically coupled to said first and second high-band dipole elements; and wherein at least one of said high-band dipole elements is formed as a flexible electrically conductive sleeve, and said flexible electrically conductive sleeve surrounds a transmission line that extends from said low-band dipole feed to said high-band dipole feed.

2. The antenna assembly according to claim 1, further comprising an RF control means configured for selectively directing RF energy in a high-band to said high-band dipole feed, and for selectively directing RF energy in a low-band to said low-band dipole feed, wherein said low band comprises an RF range that is lower as compared to an RF range of said high band.

3. The antenna assembly according to claim 2, wherein said RF control means is selected from the group consisting of an RF diplexer and an RF switch.

4. The antenna assembly according to claim 3, wherein said RF control means is an RF switch and said RF switch is controlled by a portable transceiver.

5. The antenna assembly according to claim 2, further comprising a low-band impedance matching network for said low-band dipole antenna and a high-band impedance matching network for said high-band dipole antenna, each coupled to said RF control means.

6. The antenna assembly according to claim 5, wherein said low-band dipole, feed and said RF control means are each disposed within a dielectric housing which physically supports said first and second low-band dipole elements.

7. The antenna assembly according to claim 5, wherein said high-band dipole feed further comprises a first impedance transformer electrically coupled to said first and second high-band dipole elements.

8. The antenna assembly according to claim 7, wherein said first impedance transformer is disposed within a dielectric body which supports said first and second high-band dipole elements.

9. The antenna assembly according to claim 6, wherein said low-band dipole feed further comprises a second impedance transformer electrically coupled to said first and second low-band dipole elements and to said low-band impedance matching network.

10. The antenna assembly according to claim 2, further comprising a first impedance transformer electrically coupled to said first and second high-band dipole elements, and a second impedance transformer electrically coupled to said first and second low-band dipole elements.

11. The antenna assembly according to claim 10 wherein a secondary winding of said second impedance transformer connected to said first and second low-band dipole elements has a high impedance to electric current at all frequencies in said high-band such that said second low-band dipole element is electrically isolated from said high-band dipole antenna at RF frequencies in said high band.

12. The antenna assembly according to claim 11 wherein said first impedance transformer forms a low impedance path for coupling electric current from said second high-band dipole element to said first high-band dipole element at RF frequencies in said low band.

13. The antenna assembly according to claim 1, wherein said flexible electrically conductive sleeve comprises a pair of spirally wound, interlocking, electrically conductive elements.

14. The antenna assembly according to claim 2, wherein at least a portion of said second low-band dipole element is a flexible electrically conductive sleeve.

15. The antenna assembly according to claim 14, wherein said flexible electrically conductive sleeve that defines said second low-band dipole element surrounds a second RF transmission line that extends from said low-band dipole feed to an RF input port of said antenna at a location disposed along a length of said second low-band dipole element.

16. The antenna assembly according to claim 14, further comprising one or more ferrite bodies disposed about a portion of said second RF transmission line at a location adjacent to said RF input port.

17. The antenna assembly according to claim 14, further comprising a second high-band dipole antenna including a second high-band dipole feed interposed at a location along a length of said second low-band dipole element and dividing said second low-band dipole element into a third high-band dipole element extending outwardly from said second high-band dipole feed in said first direction to said low-band dipole feed, and a fourth high-band dipole element extending in said second direction to a second terminal end of said antenna assembly opposed from said first terminal end of said antenna assembly, said second high-band dipole feed electrically coupled to said third and fourth high-band dipole elements.

18. The antenna assembly according to claim 17, wherein said flexible electrically conductive sleeve forming said second low-band dipole element surrounds a third RF transmission line that extends from said low-band dipole feed to said second high-band dipole feed.

19. The antenna assembly according to claim 17 wherein said RF control means directs RF energy in said high-band to said first and second high-band dipole feed.

20. The antenna assembly according to claim 2, wherein said low band is a VHF band and said high-band is a UHF band.

21. An antenna assembly to be worn by a user, comprising:

a low-band dipole antenna comprising a first low-band dipole antenna element and a second low-band dipole antenna element, each electrically coupled to a low-band dipole feed and respectively extending in opposing directions to first and second terminal ends of said antenna assembly;

a high-band dipole antenna comprising a high-band dipole feed disposed along a length of said first low-band dipole antenna element and separating said first low-band dipole antenna element into a first high-band dipole element extending from said high-band dipole feed in a first direction to said first terminal end of said antenna assembly, and a second high-band dipole element extending from said high-band dipole feed in a second direction to said low band-dipole feed, each of said first and second high band dipole element electrically coupled to said high-band dipole feed;

an RF control means for selectively directing RF energy to one of said low-band dipole feed and said high-band dipole feed; and wherein at least a portion of at least one of said low-band dipole elements is formed as a flexible electrically conductive sleeve, and said flexible electrically conductive sleeve surrounds a first transmission line that extends from said low-band dipole feed to said high-band dipole feed, and a second transmission line that extends from said low-band dipole feed to an RF input port of said antenna.

22. An antenna assembly to be worn by a user, comprising:

a low-band dipole antenna including a low-band dipole feed electrically coupled to a first low-band dipole element connected to and extending outwardly from said low-band dipole feed in a first direction to a first terminal end of said antenna assembly, and to a second low-band dipole element connected to and extending outwardly from said low-band dipole feed in a second direction opposed from said first direction to a second terminal end of said antenna assembly;

a first high band dipole antenna comprising a first high-band dipole feed interposed at a location along a length of said first low-band dipole element and dividing said first low-band dipole element into a first high-band dipole element extending outwardly from said high-band dipole feed in said first direction to said first terminal end of said antenna assembly, and a second high-band dipole element extending in said second direction to said low-band dipole feed, said first high-band dipole feed electrically coupled to said first and second high-band dipole elements;

a second high-band dipole antenna including a second high-band dipole feed interposed at a location along a length of said second low-band dipole element and dividing said second low-band dipole element into a third high-band dipole element extending outwardly from said second high-band dipole feed in said first direction to said low-band dipole feed, and a fourth high-band dipole element extending in said second direction to said second terminal end of said antenna assembly opposed from said first terminal end of said antenna assembly, said second high-band dipole feed electrically coupled to said third and fourth high-band dipole elements; and wherein at least a portion of each of said first and second low-band dipole elements is formed as a flexible electrically conductive sleeve that respectively surrounds a first and second transmission line that extends from said low-band dipole feed to each of said first and second high-band dipole feeds.

* * * * *